United States Patent [19]

Malito

[11] Patent Number: 4,950,415

[45] Date of Patent: Aug. 21, 1990

[54] WATER WASHABLE DRY FILM LUBRICANTS

[75] Inventor: John T. Malito, Oswego, Ill.

[73] Assignee: Nalco Chemical Company, Naperville, Ill.

[21] Appl. No.: 437,738

[22] Filed: Nov. 17, 1989

[51] Int. Cl.[5] ..... C10M 105/32

[52] U.S. Cl. ..... 252/56 R; 252/49.3; 72/42

[58] Field of Search ..... 252/49.3, 56 R; 72/42

[56] References Cited

U.S. PATENT DOCUMENTS

| | | | |
|---|---|---|---|
| 4,632,770 | 12/1986 | Slanker | 252/49.5 |
| 4,753,743 | 6/1988 | Sech | 252/33.4 |
| 4,767,554 | 8/1988 | Malito et al. | 252/49.5 |
| 4,787,991 | 11/1988 | Morozumi et al. | 252/12.4 |

*Primary Examiner*—Mark L. Bell
*Assistant Examiner*—James M. Hunter, Jr.
*Attorney, Agent, or Firm*—Wood, Phillips, Mason, Recktenwald & VanSanten

[57] ABSTRACT

Metal working lubricant compositions are provided in which a dry film of a lubricant is formed on the metal being worked. The lubricant comprises an ester having a melting point of at least 100° F. and a solid surfactant having an HLB number in the range of about 7–12. The surfactant is solid at room temperature and will cause the lubricant to disperse in water at a temperature exceeding the lubricant's melting point. Consequently, the solid surfactant incorporated in the dry film lubricant allows lubricant removal by washing of the metal with just hot water. The invention also provides for metal working methods in which the lubricants are used.

17 Claims, No Drawings

WATER WASHABLE DRY FILM LUBRICANTS

FIELD OF THE INVENTION

The present invention generally relates to the field of metal working and lubricants used therein and more particularly is concerned with dry film lubricants used in drawing and/or ironing processes particularly those involving aluminum.

BACKGROUND OF THE INVENTION

Metal working processes, such as rolling, forging, casting, blanking, bending, drawing, ironing, cutting, punching, spinning, extruding, coining, hobbing, swagging embossing, cold heading and rolling, generally employ lubricants which are applied to the metal either before or during working. The lubricant reduces the friction between the metal and the machinery being employed in the particular metal working process. The reduction in friction results in reducing both the power required in performing the process and the wear of the surfaces of both the metal being worked and the metal working machinery. It also prevents adherence or sticking between the metal and the machinery and thus promotes processability by minimizing or eliminating disruption caused by such sticking.

After working, lubricant removal from the worked metal is frequently required, depending upon the use to which the metal is to be put. For example, if the metal is to be used in food packaging, such as cans, lubricant contact with the food may not be desirable, requiring lubricant removal to avoid flavor problems.

Heretofore, removal of many lubricants entailed the use of so-called washer chemicals. Washer chemicals are often expensive and may pose handling and/or disposal problems, consequently, their use is to be avoided where possible.

Another problem in metal working with lubricants resides in the form of the lubricant being applied. Liquid lubricants have limited load bearing capabilities and may be applied in films of limited thickness, thereby limiting the force that may be applied to the metal in any given forming or working step. This in turn may increase the number of forming steps required to complete a given forming operation which will increase the length of the process and require additional equipment, adding complexity and expense to the process.

Furthermore, liquid lubricants generally are more susceptible to attack by bacteria than solid lubricants and require the use of a biocide in their composition.

Some metal working processes use more than one lubricant and/or different concentrations or applications of the same lubricant in different stages of the process. For example, in making aluminum cans, liquid lubricant may be applied following the formation of sheet at one location or point in time. At a later point in time and likely at a different location, extrusion of the sheet will also require lubricant. Liquid lubricant applied following the sheet forming stage may have evaporated, flowed from the sheet or a part thereof or otherwise be wholly or partly removed requiring further lubricant application. This increases the cost of the process and adds a further step thereto.

The present invention is directed t overcoming one or more of the above problems and providing one or more of the above advantages.

SUMMARY OF THE INVENTION

It is the principal object of this invention to provide lubrication compositions providing one or more of the following advantages for use in the processing of metals: (1) elimination or minimization of the need for multiple lubricant application steps in metal processing; (2) improved formability and superior lubrication over conventional liquid phase lubricants due to better load bearing capability; (3) greater bacteria resistance than conventional liquid phase lubricants, thereby reducing consumption of biocide; (4) elimination of flavor problems due to the lubricant; and (5) lubricant removal by use of hot water thus reducing or avoiding the need for the use of washer chemicals.

An exemplary embodiment of the invention achieves one or more of the above objects and advantages, in its broadest form, in a dry film lubricant composition for use in metal working comprising an ester capable of lubricating the interface of a body of metal and metal working apparatus working on the body and having a melting point of at least about 100° F. Also included is a surfactant that is solid at room temperature and has an HLB number in the range of about 7–12.

According to this aspect of the invention, the application of hot water to a metal body having the composition thereon will result in the melting of the ester and the surfactant will disperse the ester in the hot water to allow removal of the lubricant simply by washing in hot water. Because the lubricant is in the form of a dry film, it cannot evaporate or flow off of the metal and thus eliminates or minimizes the need for multiple lubrication applications at various stages of metal processing. Furthermore, the fact that the lubricant is dry provides better load bearing capability and better bacteria resistance.

In a preferred embodiment of the invention, the ester is formed from at least one acid selected from the group consisting essentially of lauric, myristic, palmitic, stearic, hydroxystearic, arachidic, behenic, erucic, lignoceric, citric and lactic, and at least one alcohol selected from the group consisting essentially of lauryl, myristyl, palmityl, stearyl, arachidyl, behenyl, erucyl, lignoceryl, glycerol, polyglycerol, trimethylolpropane, ethylene glycols, propylene glycols, sorbitols and polysorbitols.

In a highly preferred embodiment, the surfactant has a melting point temperature in the range of 120° –160° F. Preferably, as well, the ester has a similar melting point.

A highly preferred surfactant is that selected from the group consisting essentially of ethoxylated C12–C18 fatty acids having 2–10 moles of ethylene oxide and ethoxylated C9–C18 fatty alcohols having 2–10 moles of ethylene oxide.

The invention also contemplates that such a composition may be dispersed in water to provide an aqueous or water-based lubricant that may be applied to metal to be worked and allowed to dry prior to working. In such a case, the composition may include an effective amount of a phosphate corrosion inhibitor. Generally, the composition will further include an effective amount of copper corrosion inhibitor.

One embodiment of the invention contemplates that such a composition further include an alkoxylated amine. In a highly preferred embodiment of the invention, the composition also includes a glycol. Also contemplated is the inclusion of an alcohol selected from the group consisting essentially of lauryl, myristyl, palmityl, stearyl, arachidyl, behenyl and erucyl.

The intended water-based lubricant preferably contains about 60–90% by weight of water and about 10–30% by weight of the ester. The surfactant is preferably present to about 2–6% by weight while the inhibitors and the amine are each present to about 0–1% by weight.

The glycol may be present to the extent of 0–8% by weight and the alcohol is preferably a fatty alcohol present to the extent of 0–2% by weight.

The invention also contemplates a method of metal working wherein the composition as identified previously is first applied to a metal body to be worked, the body is then worked to a desired shape, and thereafter, the lubricant is removed by washing the body in hot water.

Other objects and advantages of the invention will become apparent from the following description.

DESCRIPTION OF THE PREFERRED EMBODIMENT

Lubricant compositions made according to the invention will be described in terms of their use in the production of, for example, aluminum cans. However, the inventive compositions may be utilized with efficacy in the formation of other aluminum objects as well as in the working of metals other than aluminum.

Preferably, though not necessarily, the inventive compositions may be mixed with water to provide an aqueous or water-based lubricant that may be placed on the metal body to be worked and then dried, as will be seen in greater detail hereinafter. In its broadest form, the invention contemplates the provision of a dry film lubricant composition that is made up of an ester of any of a variety of sorts having a melting point of at least about 100° F. A second important feature of the ester is that it be capable of lubricating the interface or point of contact between a body of metal being worked and the metal working apparatus that is applying working force to the metal body. Another desirable feature of the ester, in a broad sense, is compatibility with food stuffs without imparting or otherwise changing the flavor of the same. However, this characteristic is unnecessary where the composition is to be used in the working of metals that are not intended to come into contact with food stuffs.

An indispensable constituent of the invention is a surfactant that is solid at room temperature. It is preferred that the surfactant have an HLB number in the range of about 7 to about 12. The resulting composition, after having been applied to a body of metal and after the working of the body of the metal, may be readily removed through the application of hot water. The hot water will melt the ester and the surfactant will disperse the ester in the hot water, allowing it to be worked away.

Consequently, with these essential characteristics, a lubricating composition made according to the invention achieves the various advantages previously noted. By way of example, because the lubricant composition is a dry composition after having been applied to the body of metal to be worked, use of the inventive composition eliminates or at least minimizes the need for multiple lubricant applications during metal processing since the dry lubricant does not evaporate or flow and cannot be wiped from the surface of the metal body.

The inventive composition also provides for improved processing in a metal working process because, as a dry lubricant, it has a greater load bearing capacity than an otherwise similar liquid phase lubricant. Similarly, the fact that the lubricant is dry causes the same to have a greater bacteria resistance than liquid lubricants; and this allows a reduction in the quantity of biocide that might be required in, for example, food uses. Appropriate selection of the esters where food uses are contemplated also achieves the elimination of flavor imparting problems caused by prior lubricants.

Finally, cleaning of the metal bodies by the use of hot water is permitted as a result of the inventive composition thus reducing or avoiding entirely the need for the use of washer chemicals and the problems that attend their use.

In more specific terms, a preferred embodiment of a solid lubricant composition that may be dispersed in water for application and subsequently dried includes the following:

| Ingredient | % By Weight |
|---|---|
| Water | 60–90 |
| Solid ester formed from monobasic, dibasic or polybasic acids having 12–24 carbon atoms, and various mono-, di- or polyhydric alcohols, the solid ester having a melting point above about 100° F. | 10–30 |
| Surfactant solid at room temperature and having an HLB of 7–12 | 2–6 |
| Phosphate corrosion inhibitor | 0–1 |
| Copper corrosion inhibitor | 0–1 |
| Alkoxylated amine | 0–1 |
| Glycol | 0–1 |
| Straight chain or branched fatty acids melting above about 100° F. | 0–2 |

It is within the scope of this invention that the composition include an ester having a melting point of at least about 100° F. and a solid surfactant having an HLB number in the range of about 7–12. A solid surfactant will allow the composition to disperse in water at a temperature exceeding the melting point of the composition. A solid surfactant is a surfactant which is solid at room temperature, or approximately about 65° F.

Most preferable esters have a melting point in the range of 120°–160° F. so they will melt when exposed to hot water of similar or greater temperature. Illustrative esters include those products of the acids and the alcohols listed below.

| Acids | Alcohols |
|---|---|
| Lauric | Lauryl |
| Myristic | Myristyl |
| Palmitic | Palmityl |
| Stearic | Stearyl |
| Hydroxystearic | Arachidyl |
| Arachidic | Behenyl |
| Behenic | Erucyl |
| Erucic | Lignoceryl |
| Lignoceric | Glycerol |
| Citric | Polyglycerol |
| Lactic | Trimethylolpropane |
| | Ethylene Glycols |
| | Propylene Glycols |
| | Sorbitols |
| | Polysorbitols |

The esters are prepared using any of the conventional well-known esterification processes.

Illustrative solid surfactants may be any oil-in-water emulsifier having a melting point temperature above room temperature and having an HLB number in the range of about 7–12.

The HLB system for classifying emulsifying agents is described in detail in the publication "The HLB System", Copyright 1976, ICI America's, Revised, March, 1980. This publication describes a host of emulsifying agents and mixtures thereof which are capable of providing oil-in-water emulsions. The disclosure of this publication is incorporated by reference.

Illustrative surfactants include ethoxylated $C_{12-18}$ fatty acids having 2–10 moles of ethylene oxide and ethoxylated $C_{9-18}$ fatty alcohols having 2–10 moles of ethylene oxide. Preferable surfactants have melting points in the range of about 120°–160° F. and contribute to lubrication.

The purpose of the phosphate corrosion inhibitor is to minimize corrosion attack on ferrous metals when contacted by the aqueous composition. The effective amount of the phosphate corrosion inhibitor may vary from process to process but usually 1% by weight or less will suffice. Illustrative phosphate corrosion inhibitors include mono, di and tri alkyl esters of phosphoric acid where the alkyl group is $C_{4-18}$ or an aromatic residue.

It is beneficial to include a copper corrosion inhibitor to protect copper and copper alloy materials. A wide variety of inhibitors are usable. The effective amount of the copper corrosion inhibitor may vary from process to process. Again, 1% by weight or less will be sufficient in most instances. Illustrative copper corrosion inhibitors include mercaptobenzotriazole, benzyltriazole and tolyltriazole.

Alkoxylated amines are optionally incorporated. Illustrative examples include mono, di and triethanol amines and mono, di and tri-isopropanol amines. It is believed that the amines aid in the emulsification of the ester in hot water during washing.

While not necessary, a glycol may be added to the composition to further aid in emulsification. Preferably, a water-soluble glycol having a molecular weight of less than 400 is used. Illustrative glycols include diethylene glycol and hexylene glycol.

Also includable in the composition are alcohols which aid in emulsification and lubrication. Illustrative alcohols are those that are listed below:

| |
|---|
| Lauryl |
| Myristyl |
| Palmityl |
| Stearyl |
| Arachidyl |
| Behenyl |
| Erucyl |

The water-based lubricant is applied to the metal to be worked in any suitable fashion, as, for example, spraying or dipping. The water is permitted or caused to evaporate, leaving a dry film of the lubricant on the surface of the metal. In certain operations, evaporation of water is not necessary following application to the metal and before working the metal.

The lubricant is especially useful in the production of aluminum cans. In the production of aluminum cans, normally three lubricants are used: reoil applied at the rolling mill in the production of can stock, a lubricant used at the formation of the cup or bottom of the cans at the cupper press, and a third lubricant in the bodymaker coolant. The invention provides a lubricant which can replace all three.

The lubricant preferably is applied at the rolling mill producing the can stock. Further, the water-based lubricant may be applied if required at the cupper press using conventional equipment thereby avoiding any modification to accommodate use of the invention.

Any residual dry film lubricant remaining on the cups formed in the cupper press provides sufficient lubrication for production of the finished can in the bodymaker. Therefore, no further lubricant application in the bodymaker coolant is necessary. Only water containing a corrosion inhibiter is required in the bodymaker coolant as compared to conventional bodymaker coolants which typically require a 3–10% dispersion or emulsion of an additional lubricant. Also, since no emulsifiers need be present in the bodymaker coolant, any machine oils, aluminum fines, other debris produced during can formation, and any of the dry film lubricant which enters the coolant are all rejected and this assists in maintaining a clean coolant.

Costs are reduced in that multiple lubricants are not required. Further, since the solid phase lubricant residues on the can can be washed with just hot water, the washer chemical costs can be greatly reduced if not entirely eliminated.

The following are examples of various compositions made according to the invention.

| Ingredients | % By Weight |
|---|---|
| Example 1 | |
| Water | 70.00 |
| Stearyl Stearate | 22.05 |
| $C_{12-15}$ linear primary alcohol ethoxylate | 3.60 |
| Stearic acid, 8 moles ethoxylate | 3.60 |
| $C_{4-16}$ alcohol phosphate, diethanolamine salt | 0.30 |
| Tolyltriazole | 0.15 |
| Triethanolamine | 0.30 |
| Example 2 | |
| Water | 75.00 |
| Stearyl Stearate | 19.50 |
| Stearic acid, 8 moles ethoxylate | 2.30 |
| Polyethylene glycol (400) distearate | 1.10 |
| Stearyl alcohol | 1.10 |
| Hexylene glycol | 0.60 |
| Tridecyl acid phosphate | 0.30 |
| Tolytriazole | 0.10 |
| Example 3 | |
| Water | 70.00 |
| Ceto, stearyl stearate | 24.40 |
| Stearic acid, 8 moles ethoxylate | 3.00 |
| Polyethylene glycol (400) distearate | 1.50 |
| Diethylene glycol | 0.60 |
| Tridecyl acid phosphate | 0.30 |
| Tolyltriazole | 0.20 |
| Example 4 | |
| Water | 85.00 |
| Ethylene glycol monohydroxy stearate | 11.02 |
| $C_{12-15}$ linear primary alcohol ethoxylate | 1.80 |
| Stearic acid, 8 moles ethoxylate | 1.80 |
| Triethanolamine | 0.15 |
| $C_{4-16}$ alcohol phosphate, diethanolamine salt | 0.15 |
| Tolyltriazole | 0.08 |

The invention also provides processes for using the inventive compositions. The processes entail applying the lubricant to at least a part of the metal to be worked, working the metal to a desired shape, and removing the lubricant by washing the metal with hot water.

From the foregoing it will be appreciated that the lubricant compositions according to the invention are ideally suited for production of aluminum articles, though not restricted to such use. The compositions save money and avoid handling problems associated with conventional lubricants as they are easily washed off with just hot water, requiring little or no washer chemicals for cleaning.

Anticipated saving, excluding improved production, lower tool costs, lower maintenance costs and potentially lower waste treatment costs, appear to be on the order of 90%, a full order of magnitude less than prior art practice. And, of course, if one considers the further benefit including the ability to use higher forming pressure and thus minimize complexity of production, and the resultant reduction in the number of tools and lowering of tool costs as well as the cost of maintaining the tools and relating machinery, plus the elimination or drastic reduction of waste, such as washer chemicals, the benefits of the invention are seen to be enormous.

The increased load bearing capability results in forces on the worked metal being more evenly distributed. This in turn results in fewer fractures and better productivity since less time is required to clear fractures. Tool life is also enhanced while adequate performance is achieved over a wider range of coating weight on the can stock than would be the case with liquid lubricants.

What is claimed:

1. A dry film lubricant composition for metal working comprising an ester for lubricating the interface of a body of metal and metal working apparatus working the body and having a melting point of at least about 100° F. and a surfactant that is solid at room temperature and has an HLB number in the range of about 7–12, wherein the application of hot water to a metal body having the composition thereon will melt the ester and the surfactant will disperse the ester in the hot water for removal of the lubricant by washing in hot water.

2. The composition as recited in claim 1 wherein the ester is formed from at least one acid selected from the group consisting essentially of lauric, myristic, palmitic, stearic, hydroxystearic, arachidic, behenic, erucic, lignoceric, citric and lactic, and at least one alcohol selected from the group consisting essentially of lauryl, myristyl, palmityl, stearyl, arachidyl, behenyl, erucyl, lignoceryl, glycerol, polyglycerol, trimethylolpropane, ethylene glycols, propylene glycols, sorbitols and polysorbitols.

3. The composition as recited in claim 1 wherein the surfactant has a melting point temperature in the range of about 120°–160° F.

4. The composition as recited in claim 3 wherein the surfactant is selected from the group consisting essentially of ethoxylated C12–C18 fatty acids having 2–10 moles of ethylene oxide and ethoxylated C9–C18 fatty alcohols having 2–10 moles of ethylene oxide.

5. The composition as recited in claim 1 wherein the ester has a melting point in the range of about 120°–160° F.

6. A process for metal working utilizing a dry film lubricant composition comprising an ester having a melting point of at least about 100° F. and a surfactant that is solid at room temperature and has an HLB number in the range of about 7–12, wherein the application of hot water to a metal body having the composition thereon will melt the ester and the surfactant will disperse the ester in the hot water for removal of the lubricant by washing in hot water, comprising: applying the lubricant composition to the metal to be worked, working the metal to a desired shape, and thereafter washing the metal with hot water to remove the lubricant composition.

7. The process as recited in claim 6 wherein the metal is aluminum.

8. A composition for making an aqueous lubrication mixture to be used in metal working comprising:

an ester having a melting point of at least 100° F. and formed from at least one acid selected from the group consisting essentially of lauric, myristic, palmitic, stearic, hydroxystearic, arachidic, behenic, erucic, lignoceric, citric and lactic and at least one alcohol selected from the group consisting essentially of lauryl, myristyl, palmityl, stearyl, arachidyl, behenyl, erucyl, lignoceryl, glycerol, polyglycerol, trimethylolpropane, ethylene glycols, propylene glycols, sorbitols and polysorbitols; and a solid surfactant having an HLB in the range of about 7–12.

9. The composition as recited in claim 8 wherein the composition further includes an effective amount of phosphate corrosion inhibitor.

10. The composition as recited in claim 9 wherein the composition further includes an effective amount of copper corrosion inhibitor.

11. The composition as recited in claim 8 wherein the composition further includes an alkoxylated amine.

12. The composition as recited in claim 8 wherein the composition further includes a glycol.

13. The composition as recited in claim 8 further includes an alcohol selected from the group consisting essentially of lauryl, myristyl, palmityl, stearyl, arachidyl, behenyl and erucyl.

14. An aqueous lubrication composition for application to a metal to be worked, comprising:

about 60–90% by weight of water;

about 10–30% by weight of an ester having a melting point of at least about 100° F.;

about 2–6% by weight of a solid surfactant having an HLB number in the range of about 7–12;

about 0–1% by weight of a phosphate corrosion inhibitor;

about 0–1% by weight of a copper corrosion inhibitor;

about 0–1% by weight of an alkoxylated amine;

about 0–8% by weight of a glycol; and about 0–2% by weight of a fatty alcohol selected from the group consisting essentially of lauryl, myristyl, palmityl, stearyl, arachidyl, behenyl and erucyl.

15. The composition as recited in claim 14 wherein the surfactant, ester, and fatty alcohol all have melting points in the range of about 120°–160° F.

16. A process for metal working comprising the steps of applying an aqueous lubrication composition comprising:

about 60–90% by weight of water;

about 10–30% by weight of a ester having a melting point of at least about 100° F.;

about 2–6% be weight of a solid surfactant having an HLB number in the range of abut 7–12;

about 0–1% by weight of a phosphate corrosion inhibitor;

about 0–1% weight of a copper corrosion inhibitor;

about 0–1% by weight of an alkoxylated amine;

about 0–8% by weight of a glycol; and about 0–2% by weight of a fatty alcohol selected from the group consisting essentially of lauryl, myristyl, palmityl, stearyl, arachidyl, behenyl and erucyl, to the metal to be worked, working the metal to a desired shape, and thereafter washing the metal with hot water to remove the lubricant composition.

17. The process as recited in claim 16 wherein the metal is aluminum.

* * * * *

UNITED STATES PATENT AND TRADEMARK OFFICE

CERTIFICATE OF CORRECTION

PATENT NO. : 4,950,415

DATED : August 21, 1990

INVENTOR(S) : John T. Malito

It is certified that error appears in the above-identified patent and that said Letters Patent is hereby corrected as shown below:

Column 1, line 66, change "t" to --to--.

Column 4, line 68, change "esterification" to --esterfication--

Signed and Sealed this

Tenth Day of December, 1991

*Attest:*

HARRY F. MANBECK, JR.

*Attesting Officer*

*Commissioner of Patents and Trademarks*